US006422862B1

(12) United States Patent
Arechavaleta-Villarreal

(10) Patent No.: US 6,422,862 B1
(45) Date of Patent: Jul. 23, 2002

(54) INSULATION SYSTEM FOR FURNACES AND KILNS

(75) Inventor: Arturo Arechavaleta-Villarreal, Nuevo León (MX)

(73) Assignee: Nutec Industrial, S.A. de C.V., Santa Catarina (MX)

( * ) Notice: Subject to any disclaimer, the term of this patent is extended or adjusted under 35 U.S.C. 154(b) by 0 days.

(21) Appl. No.: 09/565,708

(22) Filed: May 5, 2000

(51) Int. Cl.[7] ..... F27B 14/08

(52) U.S. Cl. ..... 432/248; 110/332; 110/336; 428/45; 428/47; 428/54; 428/55; 428/99; 428/120

(58) Field of Search ..... 428/45, 47, 54, 428/55, 99, 120; 122/164; 110/336, 332; 432/248; 52/404.1

(56) References Cited

U.S. PATENT DOCUMENTS 4,850,171 A * 7/1989 Deren ..... 110/336

* cited by examiner

*Primary Examiner*—Alexander S. Thomas

(74) *Attorney, Agent, or Firm*—Abelman, Frayne & Schwab

(57) ABSTRACT

An insulation system for furnaces and kilns in which the number of splits between the insulation modules and the heat leaks produced at open sections caused by temperature changes are eliminated, for using in structures having: a frame including a first and a second lateral sides in relation with a transversal axis; one or more openings including a surrounding frame, constituting a flue, each opening having two lateral sides and two longitudinal sides in relation with said transversal and whit a longitudinal axis; and a structural base, located inside the frame and coupled thereof, having an internal side facing to the housing of the furnace and an external side facing to the exterior of the furnace, said insulation structure comprising a first and a second elongated insulation modules having an upwardly projecting housing which isolates a longitudinal side of the flue frame; and a third and a fourth elongated insulation modules, having a vertical section which isolates a lateral side of the flue frame.

6 Claims, 5 Drawing Sheets

INSULATION SYSTEM FOR FURNACES AND KILNS

BACKGROUND OF THE INVENTION

A. Field of the Invention

This invention relates to insulation modules for roofs or doors of furnace housings, and more particularly to an insulation system for furnace roofs or doors of furnace housings having openings for fluses, in which the number of splits between the insulation modules are eliminated, and in which the heat leaks produced at open sections caused by temperature changes are eliminated.

B. Description of the Related Art

There are well known the insulation systems for using in doors or roofs of furnace housings having a frame and an structural base, wherein the insulation system is comprised by several insulation modules made from fiber mats attached to a structural base such as metal mesh means, plate channels etc.

Generally the known furnace housing structures comprises: a rectangular frame having a first and a second lateral side and a first and a second longitudinal side, including one quadrangular opening having a surrounding frame which constitute the flue of the furnace; a structural base such a as metal mesh means; a insulation system comprising a plurality of insulation modules attached to the structural base by anchoring means, divided in five sections: a first and a second section situated along the longitudinal sides, a third section surrounding the flue situated at a central portion of the frame, between the first and the second section, a fourth section extending from the first lateral side to the third section, between the first and the second sections, and a fifth section extending from the third section to the second lateral side, between the first and the second sections.

The main problem of the above referred insulation system is related to heat leaks at the section surrounding the flue. This section is formed by eight or more fiber insulation modules surrounding each external wall of the flue and each comer thereof.

This heat leaks are produced at the joints between the insulation modules surrounding the flue, due to the constant temperature changes at the hot portion of the insulation module which produces a continuous expansion-contraction cycle.

This constant expansion-contraction cycle produces open sections at the joints between the insulation modules surrounding the flue, causing heat leaks and damaging the structural base, and in order to seal the heat leaks produced at the open sections, it is necessary to repack the modules aside the open sections.

In order to solve the above referred problems, applicants developed a new insulation system in which the number of splits between the insulation modules are eliminated specially around the flue, and in which the heat leaks produced at open sections caused by temperature changes are eliminated.

The insulation system developed by the applicants comprises: a first and a second elongated insulation modules, each extending from the first lateral side of the frame to the second lateral side thereof, and each having one or more projections each including a gradually deepen blade cut housing, coinciding with a flue opening of the frame, in order to accommodate and isolate a longitudinal side of the rectangular frame that forms the flue of the furnace; a third and a fourth elongated insulation modules, each extending respectively from the first and second lateral sides of the frame to the first and second lateral sides of the surrounding frame of a flue, having one or two opposite vertical sections each located at an end of the elongated module, forming a vertical wall which isolates the lateral side of a surrounding frame of a first and/or a second flue located over the longitudinal axis, and having the same shape of the lateral side of the surrounding frame of the flue; and anchoring means, in order to fasten the first and second insulation modules to the internal side of the structural base, to fasten the projection which isolates the longitudinal side of the surrounding frame of the flue to said surrounding frame, to fasten the third and fourth elongated insulation modules to the structural base and to fasten the vertical section of the third and fourth insulation modules to the longitudinal side of the surrounding frame of the flue.

The third section of the insulation system of the prior art is eliminated, and substituted by the longitudinal elongated insulation modules; the number of splits between the insulation modules are reduced, thus eliminating the points where open sections may appear due to temperature changes, extending the lifetime of the insulation system.

SUMMARY OF THE INVENTION.

It is therefore a main objective of the present invention to provide an insulation system having an improved durability.

It is also a main objective of the present invention to provide an insulation system in which the number of splits between the insulation modules are eliminated.

It is another objective of the present invention to provide an insulation system in which the heat leaks produced at open sections caused by temperature changes are eliminated.

It is still another objective of the present invention, to provide an insulation system in which a periodical repack of the modules aside the open sections caused by heat changes is not needed.

These and other objects and advantages of the insulation system of the present invention will become apparent to those persons having an ordinary skill in the art, from the following detailed description of the embodiments of the invention which will be made with reference to the accompanying drawings.

DETAILED DESCRIPTION OF THE INVENTION

Figure 1:
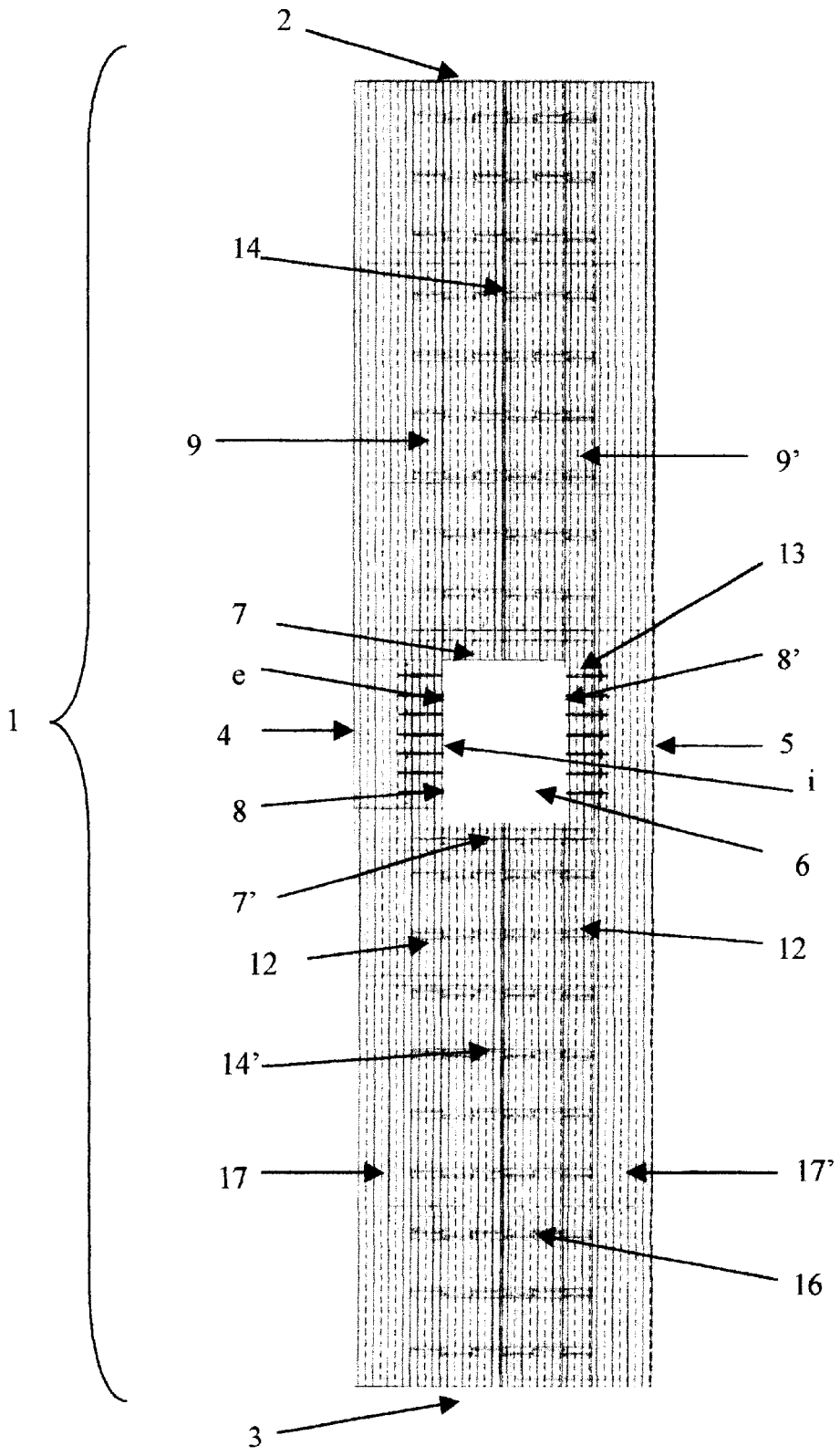
FIG. 1 is an upper view of a furnace roof having the insulation system of the present invention.
Figure 2:
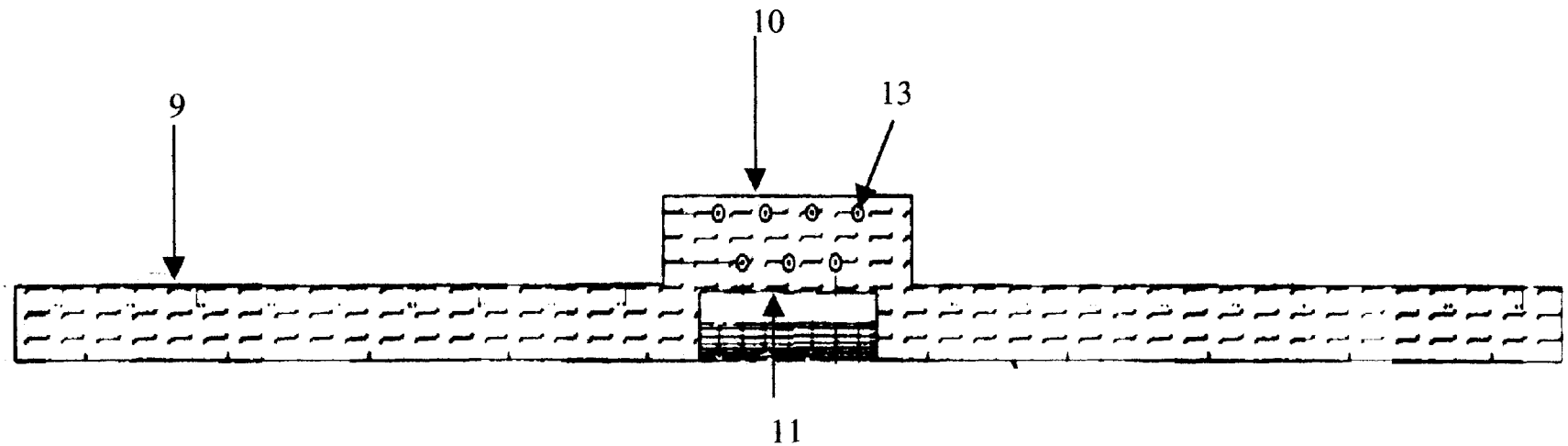
FIG. 2 is a lateral view of the insulation module which isolates the longitudinal side of the surrounding frame of a flue.
Figure 3:
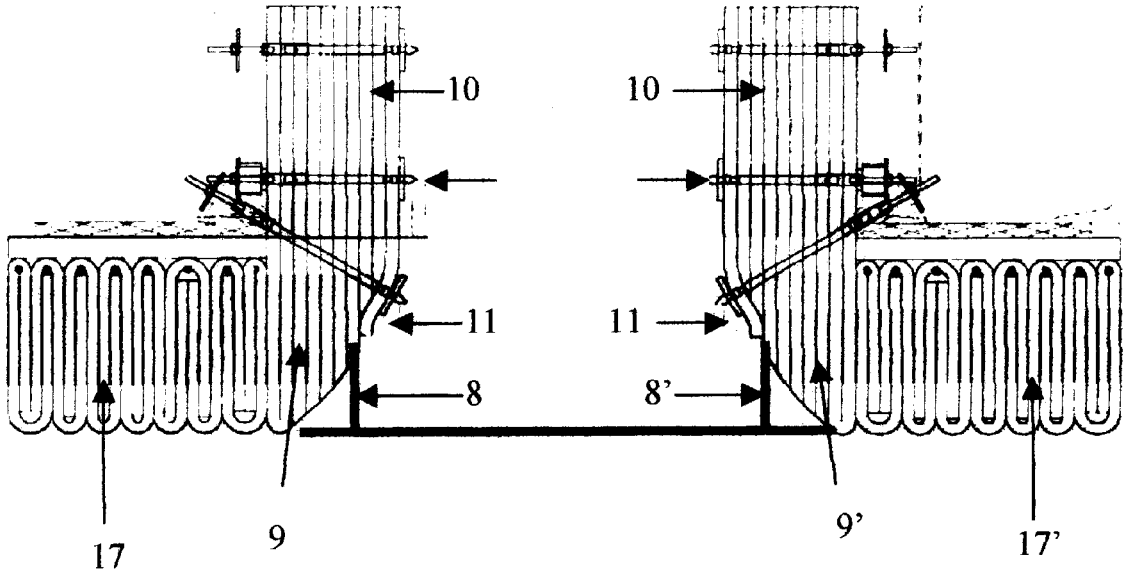
FIG. 3 is a cross section view of the insulation system of the present invention.
Figure 4:
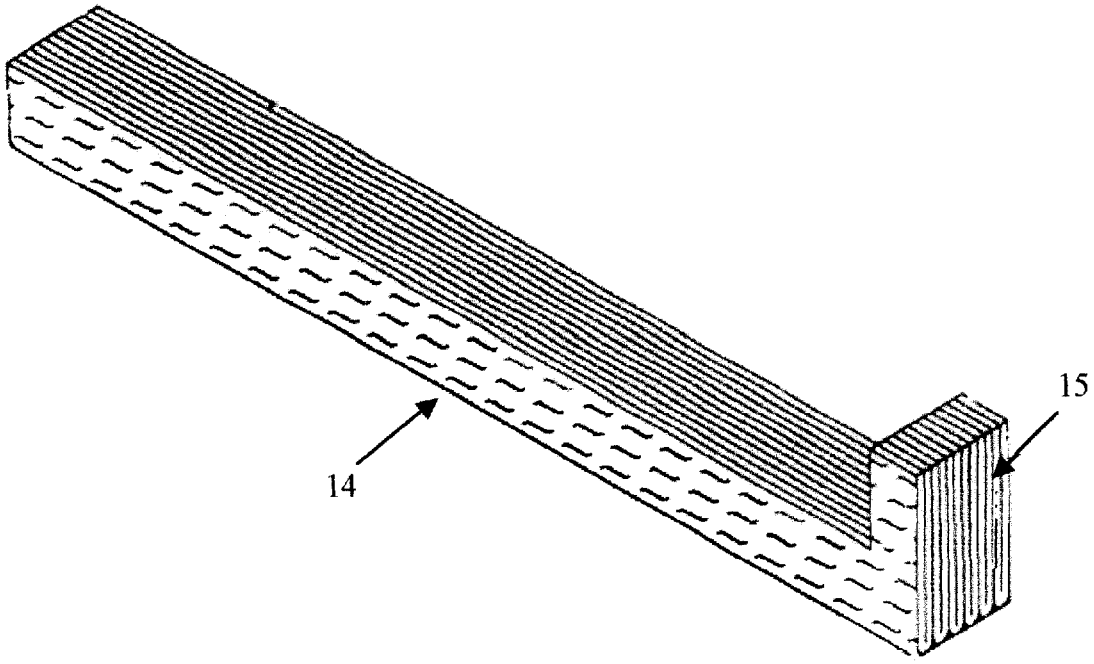
FIG. 4 is a perspective view of the third elongated insulation module of the present invention having one vertical section which isolates a lateral wall of the surrounding frame of a flue.
Figure 5:
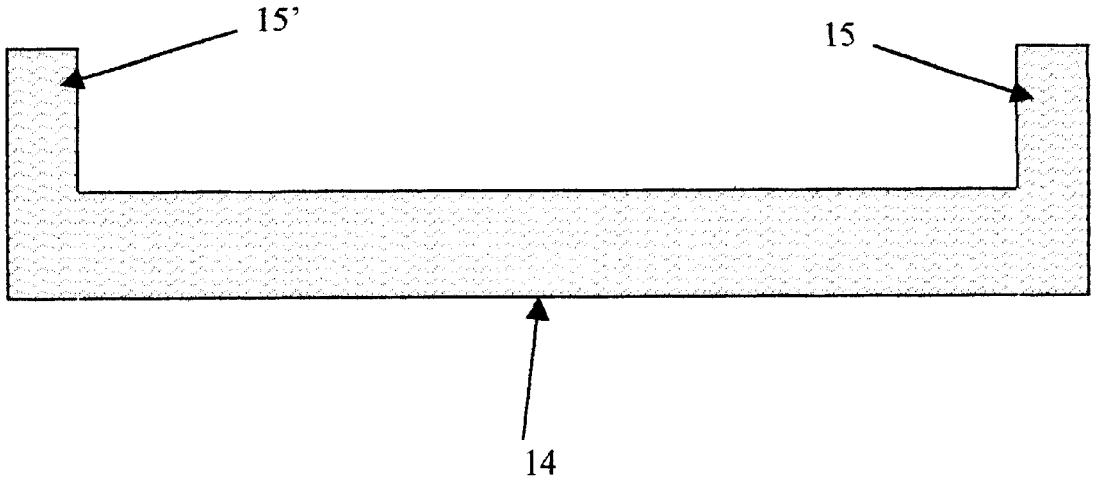
FIG. 5 is a lateral view of the third elongated insulation module of the present invention adapted to be installed at frames having two flue openings, having two vertical sections, each one isolating a lateral wall of the surrounding frame of a flue.

The invention will now be described referring to a preferred embodiment thereof, illustrated in the accompanying drawings wherein the same signs and numbers, refer to the same parts of the shown figures.

An insulation system for a wall or roof of a furnace housing having: a rectangular frame 1 having a first 2 and a second lateral sides 3 and a first 4 and a second 5 longitudinal sides; one rectangular opening 6 including a surrounding frame having two lateral walls 7,7', and two longitudinal walls 8,8', each including an external "e" and a internal side "i", constituting a flue; and a structural base (not shown) which could be metal mesh means, located inside the rectangular frame 1, coupled to the longitudinal sides 4,5 and to the lateral sides 2,3 by weld or any other known means, having an internal side (not shown) facing the housing of the furnace and an external side (not shown), wherein the insulation system formed by mat means of fibrous insulating material having U-shaped sections comprising:

a first and a second elongated insulation modules 9,9', each respectively aside the first and second longitudinal wall 8,8' of the surrounding frame which constitute the flue and each extending from the first lateral side of the rectangular frame 2 to the second lateral side thereof 3, and each having a projection 10 including a gradually deepen blade cut 11 housing located at a the central portion of each elongated insulation module 9,9', coinciding with the flue, in order to accommodate and isolate a longitudinal wall 8,8' of the rectangular frame which forms the flue of the furnace, so the housing of each elongated insulation module 9,9' covers said flue wall 8,8', and including anchoring means 12 comprising brackets, in order to fasten each elongated insulation module 9,9' to the metal mesh means (not shown) and further including anchoring means comprising ceramic studs 13 in order to fasten the projection 10 which isolates a longitudinal wall 8,8' of the flue to said longitudinal wall 8,8';

a third and a fourth elongated insulation modules 14,14', each extending respectively from the first and second lateral sides of the rectangular frame 2,3 to the first and second lateral walls of the flue 7,7' respectively, and having the same width as the lateral walls of the flue 7,7', and each having a vertical section 15 forming a vertical wall which isolates a lateral wall 7,7' of the flue, and including anchoring means 16 comprising brackets, in order to fasten the third and fourth elongated insulation modules 14,14' to the metal mesh means and further including anchoring means 16 comprising ceramic studs in order to fasten the vertical section 15 which isolates a longitudinal wall of the flue 8,8' to said longitudinal walls 8,8';

a fifth and a sixth insulation modules 17,17', each extending from a lateral side of the rectangular frame to 2 a lateral side 3 thereof, and each respectively aside the first and second insulation modules 9,9', and including anchoring means (not shown) comprising brackets in order to fasten the fifth and sixth elongated insulation modules 17,17' to the metal mesh means (not shown);

Although it has been said that the support structure has only one rectangular opening with its respective surrounding frame constituting the flue, it can have two ore more fluses depending of the requirement or size of the furnace.

In the same way, each of the first and second elongated fiber insulation modules 9,9' can have one ore more projections 10 depending on the number of fluses, in order to accommodate and isolate the longitudinal walls 8,8' of two or more fluses.

Similarly, the number of insulation modules of the type and characteristics of the third and fourth insulation modules 14,14' can be duplicated and/or modified in order to be adapted to isolate the lateral walls 7,7' of two or more fluses, such as the addition of a second vertical section 15' opposite to the first vertical 16 section in order to isolate the lateral wall of a second flue (not shown).

Although it was said that the frame 1, the structural base (not shown) and the surrounding frame of the fluses have a rectangular shape, they may have any shape, to which the insulation modules of the insulation system can be easily adapted.

And although it has been said that the mats means of fibrous material has U-shaped sections, they can have any shape including a U, S or C shape.

Furthermore, the elongated fiber insulation modules may be blocks of any kind of insulation material.

I claim:

1. An insulation system for furnaces and kilns for use in wall or roof structures comprising, a frame including first and second lateral sides with reference to a transverse axis; one or more openings including a surrounding frame, constituting a flue, each opening having two lateral sides and two longitudinal sides with reference to said transverse axis and with a longitudinal axis; and a structural base, located and joined inside the frame and having an internal side facing the housing of the furnace and an external side facing the exterior of the furnace, wherein the insulation system comprises:

first and second elongated insulation modules, each extending from the first lateral side of the frame to the second lateral side thereof, and each having one or more projections including a housing coinciding with a flue opening of the frame to accommodate and isolate a longitudinal side of the rectangular frame which forms the flue of the furnace;

third and fourth elongated insulation modules, each extending respectively from the first and second lateral sides of the frame to the first and second lateral sides of the surrounding frame of a flue, having one or two opposite vertical sections each located at an end of the elongated module, forming a vertical wall which isolates the lateral side of a surrounding frame of a flue located over the longitudinal axis, and having the same shape as the lateral side of the surrounding frame of the flue;

anchoring means fastening the first and second insulation modules to the internal side of the structural base, fastening the projection which isolates the longitudinal side of the surrounding frame of the flue to said surrounding frame, fastening the third and fourth elongated insulation modules to the structural base and fastening the vertical section of the third and fourth insulation modules to the longitudinal side of the surrounding frame of the flue.

2. The insulation system as claimed in claim 1, wherein the housing of the first and the second elongated insulation modules comprise a gradually deepening blade cut.

3. The insulation system as claimed in claim 1, further including a fifth and a sixth insulation modules, each extending from the first lateral side of the frame to the second lateral side thereof, respectively aside the first and second insulation modules, in order to isolate the longitudinal side of the frame.

4. The insulation system as claimed in claim 1, wherein the anchoring means comprises brackets.

5. The insulation system as claimed in claim 1, wherein the anchoring means comprises ceramic studs.

6. The insulation system as claimed in claim 1 wherein the insulation modules comprises mat means of fibrous insulating material, including "U" shaped, "S" shaped or "C" shaped sections interleaved to each other.

* * * * *